US007660337B2

(12) United States Patent
Teeples et al.

(10) Patent No.: US 7,660,337 B2
(45) Date of Patent: Feb. 9, 2010

(54) LIFTING APPARATUS AND METHOD OF LIFTING CARBON BASED ELECTRODES

(75) Inventors: Henry Darral Teeples, Columbia, TN (US); John Douglas Phillips, Columbia, TN (US); David Arthur Lehr, Franklin, TN (US); Thomas Davis Schiller, Franklin, TN (US); Terrence Patrick Wells, Strongsville, OH (US)

(73) Assignee: GrafTech International Holdings Inc., Parma, OH (US)

( * ) Notice: Subject to any disclaimer, the term of this patent is extended or adjusted under 35 U.S.C. 154(b) by 128 days.

(21) Appl. No.: 11/468,550

(22) Filed: Aug. 30, 2006

(65) Prior Publication Data

US 2008/0084909 A1 Apr. 10, 2008

(51) Int. Cl.
*H05B 7/14* (2006.01)

(52) U.S. Cl. ..... 373/92; 373/101; 373/52; 403/42

(58) Field of Classification Search ..... 373/92, 373/93, 101, 52, 95; 338/332; 313/238, 313/32, 35; 403/267, 270, 296, 42; 156/273.9, 156/275.5, 275.7

See application file for complete search history.

(56) References Cited

U.S. PATENT DOCUMENTS

| | | | | | |
|---|---|---|---|---|---|
| 824,153 | A | * | 6/1906 | Gazda | 373/101 |
| 3,517,954 | A | | 6/1970 | Snyder et al. | |
| 3,814,828 | A | * | 6/1974 | Gazda | 373/92 |
| 4,715,042 | A | | 12/1987 | Heggart et al. | 373/74 |
| 4,813,055 | A | | 3/1989 | Heggart et al. | 373/74 |
| 4,815,096 | A | | 3/1989 | Burwell | 373/74 |
| 4,849,987 | A | | 7/1989 | Miner, Jr. et al. | 373/74 |

* cited by examiner

*Primary Examiner*—Quang T Van
(74) *Attorney, Agent, or Firm*—Waddey & Patterson, P.C.; James R. Cartiglia

(57) ABSTRACT

A lifting apparatus for transporting a carbon based electrode having a threaded male end. The apparatus includes a casing having a top end and a bottom end. The casing defines an electrode aperture from the bottom end shaped to accept the threaded male end of the carbon based electrode to secure the lifting apparatus to the electrode. An attachment aperture is positioned in the top end while an attachment element is positioned in the attachment aperture and operatively engaging the top end of the casing. The attachment element is positioned to accept engagement from a crane or other powered lifting device, while the lifting apparatus is preferably manually attachable to the electrode.

17 Claims, 5 Drawing Sheets

LIFTING APPARATUS AND METHOD OF LIFTING CARBON BASED ELECTRODES

We, Henry Darrel Teeples, a citizen of the United States, residents at 5034 Brookside Dr., Columbia, Tenn. 38401; John Douglas Phillips, a citizen of the United States, residing at 320 West 9th, Columbia Tenn. 38401; David Arthur Lehr, a Citizen of the United States, residing at 310 Megan Ct., Franklin, Tenn. 37064; Thomas Davis Schiller, a citizen of the United States, residing at 106 Trace End Dr., Franklin Tenn. 37069; and Terrence Patrick Wells, a citizen of the United States, residing at 20342 Morar Circle, Strongsville, Ohio 44149; have invented a new and useful "Lifting Apparatus and Method of Lifting Carbon Based Electrodes."

All patents and publications described or discussed herein are hereby incorporated by reference in their entireties.

BACKGROUND OF THE INVENTION

1. Field of the Invention

The present invention relates generally to the movement of electrodes used in the processing of materials. This invention finds particular application in conjunction with the transportation of carbon based electrodes used to transmit energy used to process metal in metallurgical vessels, including electric arc furnace systems. More particularly, but without limitation, this invention relates to the manual assembly and disassembly of the apparatus with respect to a graphite electrode to facilitate transportation and holding of the graphite electrode used in a metal processing procedure.

2. Discussion of the Art

It will be appreciated by those skilled in the art that metallurgical vessels are used in the processing of molten materials to house the molten material during the heating step of the processing. These metallurgical vessels can process such molten materials as steel and slag. Carbon based electrodes are used to transmit the energy to the materials housed within the metallurgical vessels. These conventional metallurgical vessels include cooling systems used to regulate the temperature of the metallurgical vessels. For example, furnace systems of the types disclosed in U.S. Pat. Nos. 4,715,042, 4,813,055, 4,815,096 and 4,849,987 are types of these conventional metallurgical vessels.

Graphites electrodes are one type of carbon based material used to comprise the energy transferring electrodes used in metallurgical vessels. Graphite electrodes are used in the steel industry to melt the metals and other ingredients used to form steel in electrothermal furnaces. The heat needed to melt metals is generated by passing current through one or a plurality of electrodes, usually three, and forming an arc between the electrodes and the metal. Electrical currents in excess of 100,000 amperes are often used. The resulting high temperature melts the metals and other ingredients. Generally, the electrodes used in steel furnaces each consist of electrode columns, that is, a series of individual electrodes joined to form a single column. In this way, as electrodes are depleted during the thermal process, replacement electrodes can be joined to the column to maintain the length of the column extending into the furnace.

Conventionally, electrodes are joined into columns via a pin (sometimes referred to as a nipple) that functions to join the ends of adjoining electrodes. Typically, the pin takes the form of opposed male threaded sections or tangs, with at least one end of the electrodes comprising female threaded sections capable of mating with the male threaded section of the pin. Thus, when each of the opposing male threaded sections of a pin are threaded into female threaded sections in the ends of two electrodes, those electrodes become joined into an electrode column. Commonly, the joined ends of the adjoining electrodes, and the pin therebetween, are referred to in the art as a joint.

Alternatively, the electrodes are formed with a male threaded protrusion or tang machined into one end and a female threaded socket machined into the other end, such that the electrodes can be joined by threading the male tang of one electrode into the female socket of a second electrode, and thus form an electrode column. The joined ends of two adjoining electrodes in such an embodiment is referred to in the art as a male-female joint.

Given the extreme thermal stress that the electrode and the joint (and indeed the electrode column as a whole) undergoes, mechanical/thermal factors such as strength, thermal expansion, and crack resistance must be carefully balanced to avoid damage or destruction of the electrode column or individual electrodes. For instance, longitudinal (i.e., along the length of the electrode/electrode column) thermal expansion of the electrodes, especially at a rate different than that of the pin, can force the joint apart, reducing effectiveness of the electrode column in conducting the electrical current. A certain amount of transverse (i.e., across the diameter of the electrode/electrode column) thermal expansion of the pin in excess of that of the electrode may be desirable to form a firm connection between pin and electrode; however, if the transverse thermal expansion of the pin greatly exceeds that of the electrode, damage to the electrode or separation of the joint may result. Again, this can result in reduced effectiveness of the electrode column, or even destruction of the column if the damage is so severe that the electrode column fails at the joint section. Thus, control of the thermal expansion of an electrode, in both the longitudinal and transverse directions, is of paramount importance.

Correspondingly, the transfer and positioning of these graphite electrodes during the metallurgical processes is also important. This is because any damage experienced by the electrodes in their handling, movement, and positioning before, during, and after a given metallurgical process can also result in reduced effectiveness, and/or destruction, of an electrode column.

Conventionally, the electric arc furnace industry uses what is known in the art as a "Threaded Stem Lift Plug" to transport the electrodes. The Threaded Stem Lift Plug is inserted into the female end of the electrode, and normally threaded into position. This threaded stem lift plug cannot attach to the threaded male end of an electrode.

What is needed, then, is a transport apparatus and method for transporting carbon based electrodes used to transmit energy in the processing of metal in metallurgical vessels. This needed transport apparatus and method for transporting can preferably include a shaped aperture positioned to removably engage the electrodes and transport the electrodes for processing. This needed transport apparatus and method for transporting can preferably be shaped to and comprised of materials that allow manual assembly and disassembly of the apparatus with respect to the electrode. This transport apparatus and method for transporting is currently lacking in the art.

SUMMARY OF THE INVENTION

The current invention includes a lifting apparatus for transporting a carbon based electrode having a threaded male end. The apparatus comprises a casing having a top end and a bottom end. The casing defines an electrode aperture from the bottom end shaped to accept the threaded male end of the carbon based electrode to secure the lifting apparatus to the electrode. An attachment aperture is positioned in the top end while an attachment element is positioned in the attachment aperture and operatively engaging the top end of the casing. The attachment element is positioned to accept engagement from a crane or other powered lifting device, while the lifting apparatus is preferably manually attachable to the electrode.

The casing preferably is tapered from the bottom end to the top end and includes a length. A threaded internal surface substantially spans the length wherein the threaded internal surface mates with the threaded male end of the electrode. The casing can further include an external surface and a handle attached to the external surface wherein the handle is preferably positioned proximate to the bottom end and spaced from the external surface. The casing can also further include a cross-sectional shape taken perpendicular to the length of the case wherein the cross-sectional shape is substantially circular.

The attachment aperture of the case further includes an aperture length and attachment threads substantially spanning the aperture length. The attachment element can further include a gripping element and casing threads extending from the gripping element. The attachment threads mate with the casing threads to secure the attachment element to the top end of the casing. Alternately the attachment element can be attached to the top end by a fastener, such as a bolt and nut combination, rivet, and the like.

An indexing element can be positioned within the casing proximate to the top end wherein the indexing element is positioned to regulate the movement of the carbon based electrode and the casing with respect to the attachment element. This indexing element can extend from the attachment element and can include the casing threads that index with the attachment threads to position this indexing element.

Also included is a lifting apparatus for transporting a graphite electrode wherein the graphite electrode includes a threaded male end. The apparatus comprises a tapered boundary wall including a lifting end and an electrode end. The tapered boundary wall defines an electrode opening in the electrode end and a lifting opening in the lifting end. The electrode opening includes at least one electrode thread shaped to securely engage the threaded male end of the graphite electrode in the electrode opening. The lifting opening includes at least one lifting thread positioned therein. A lifting element is positioned in the lifting opening and includes a threaded extension operatively engaging the lifting thread to securely engage the lifting element in the lifting opening.

The tapered boundary wall is preferably substantially bell shaped and includes a length wherein at least one electrode thread substantially spans the length.

The lifting element, including the lifting thread, preferably extends within the tapered boundary wall from the lifting end towards the electrode end and restricts movement of the graphite electrode within the tapered boundary wall. The lifting element can further include a connection protrusion extending from the threaded extension to engage the threaded male end of the graphite electrode. Additionally, the lifting opening can further include an opening length wherein the at least one lifting thread substantially spans the opening length.

Also included is a method of lifting a carbon based electrode having a threaded male end. The method comprises providing a lifting apparatus having internal threads and attaching the internal threads of the lifting device to the threads of the threaded male end. The method includes indexing the carbon based electrode a secure distance within the lifting apparatus and lifting the carbon based electrode by the lifting apparatus. Preferably the method further includes allowing substantially unobstructed access to the carbon based electrode below the threaded male end. Preferably the attaching of the internal threads of the lifting up device and the indexing of the carbon based electrode within a lifting apparatus are performed manually.

It is therefore a general object of the present invention to provide a lifting apparatus for carbon based electrodes.

Another object of the present invention is to provide a method for transporting carbon based electrodes by attaching to a threaded male end of the carbon based electrodes.

Still another object of the present invention is to provide a lifting apparatus having internal threads positioned to mate with the carbon based electrodes.

Another object of the present invention is to provide a lifting apparatus that can be manually attached to carbon based electrodes.

Yet still another object of the present invention is to provide a lifting device that has internal elements used to index the depth a carbon based electrode is inserted into the lifting apparatus.

Other and further objects, features and advantages of the present invention will be readily apparent to those skilled in the art upon reading of the following disclosure when taken in conjunction with the accompanying drawings.

DETAILED DESCRIPTION OF THE PREFERRED EMBODIMENT

Figure 1:
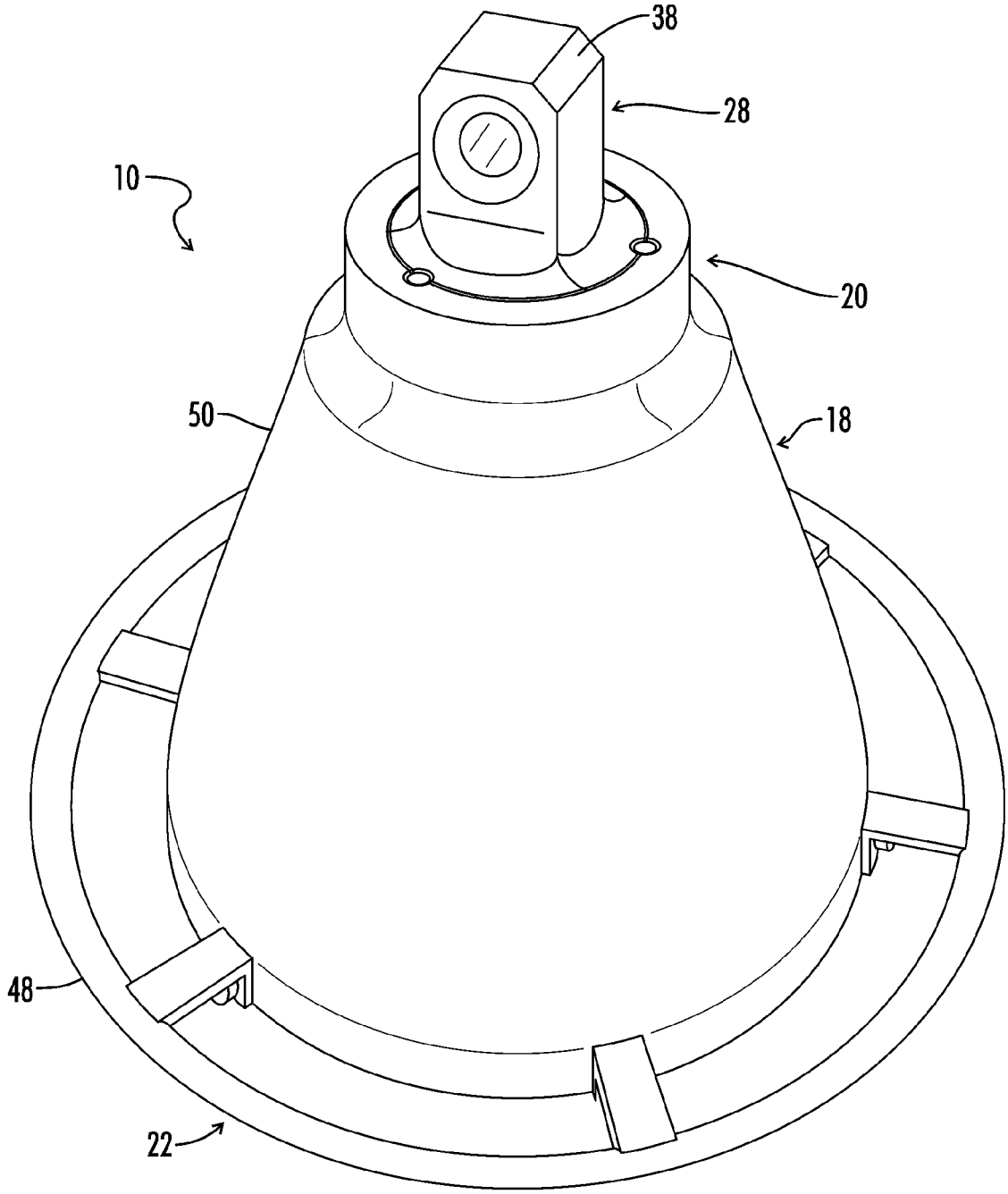
FIG. 1 is a perspective view of an embodiment of a lifting apparatus made in accordance with the current disclosure
Figure 2:
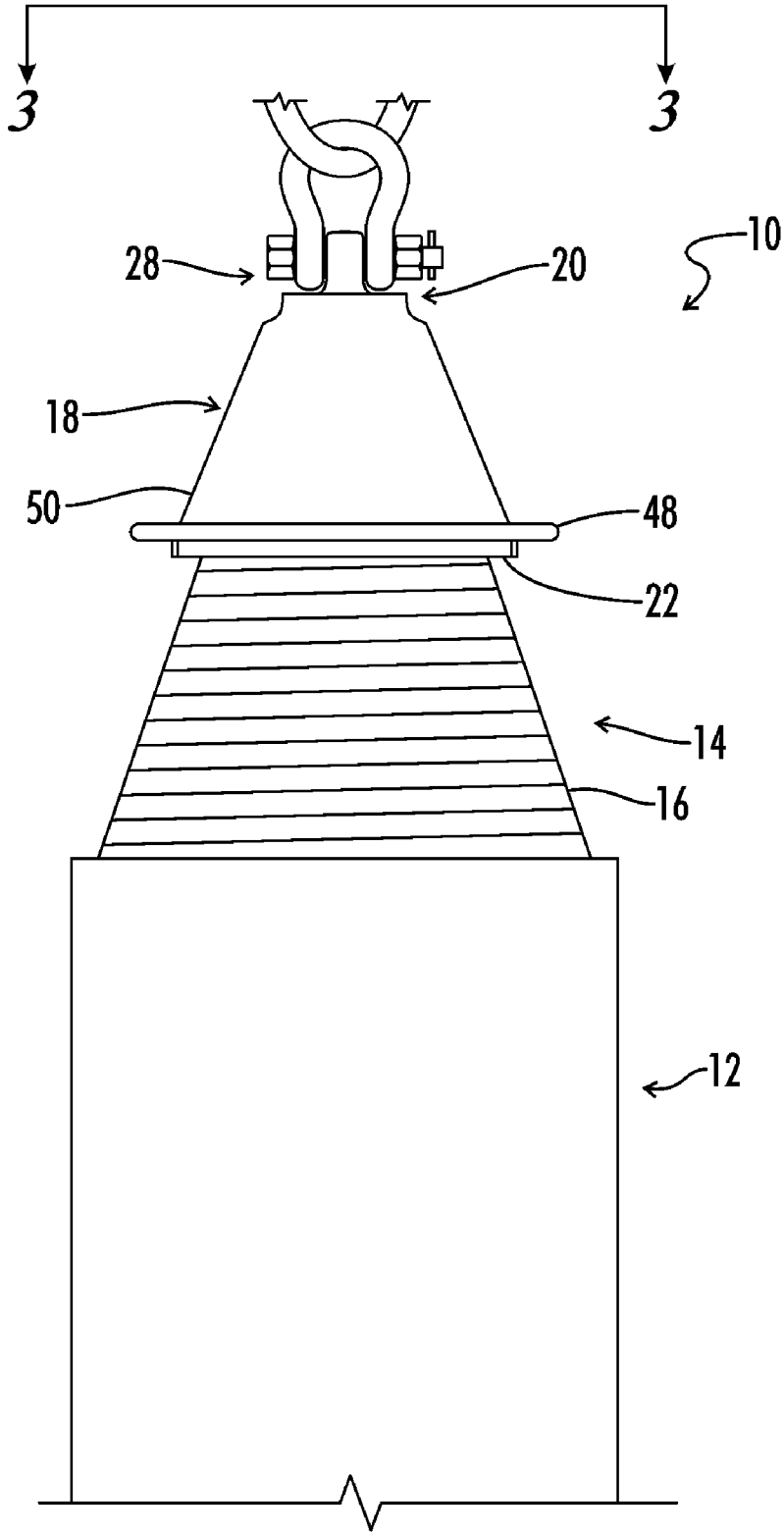
FIG. 2 is a front view of a lifting apparatus made in accordance with the current disclosure attached to the threaded male end of a carbon based electrode.
Figure 3:
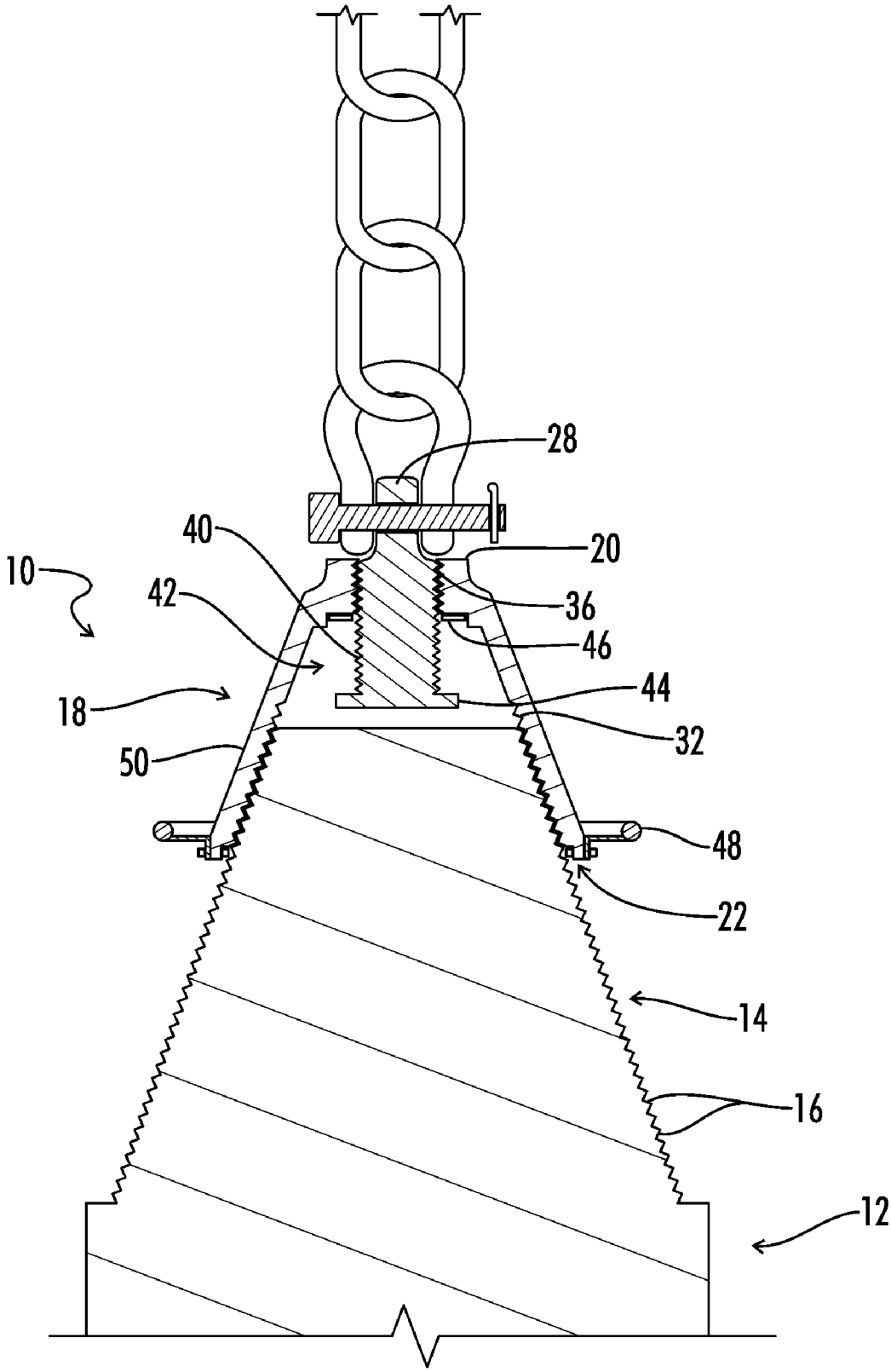
FIG. 3 is a partial cross-sectional view taken along line 3-3 in FIG. 2.
Figure 4:
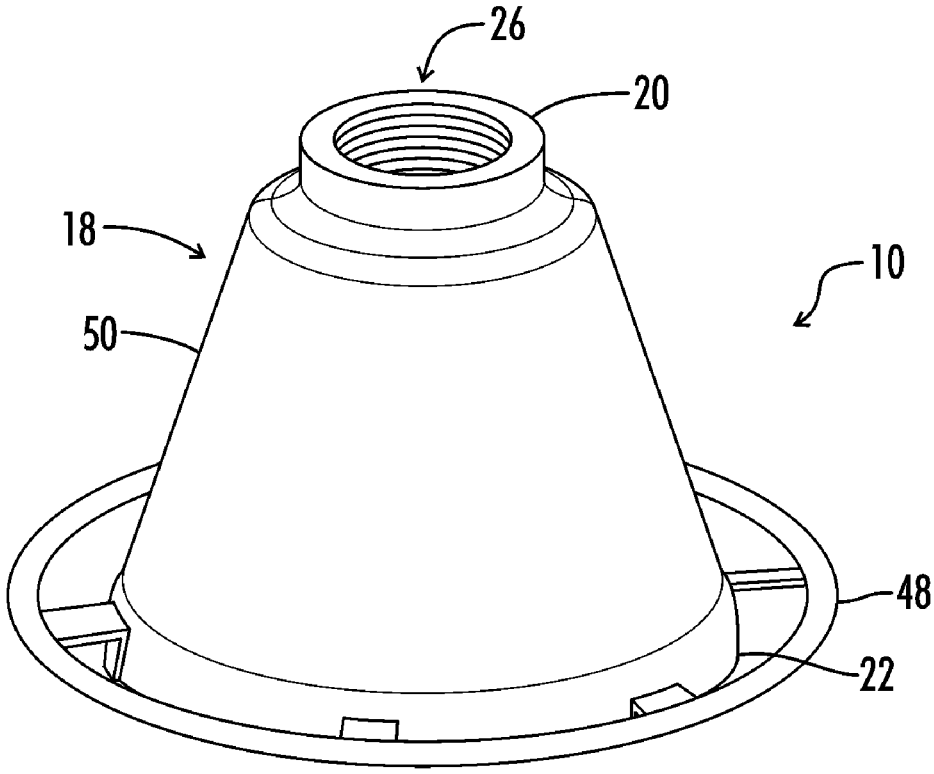
FIG. 4 is a perspective view of a lifting apparatus made in accordance with the current disclosure with the attachment element removed form the casing.
Figure 5:
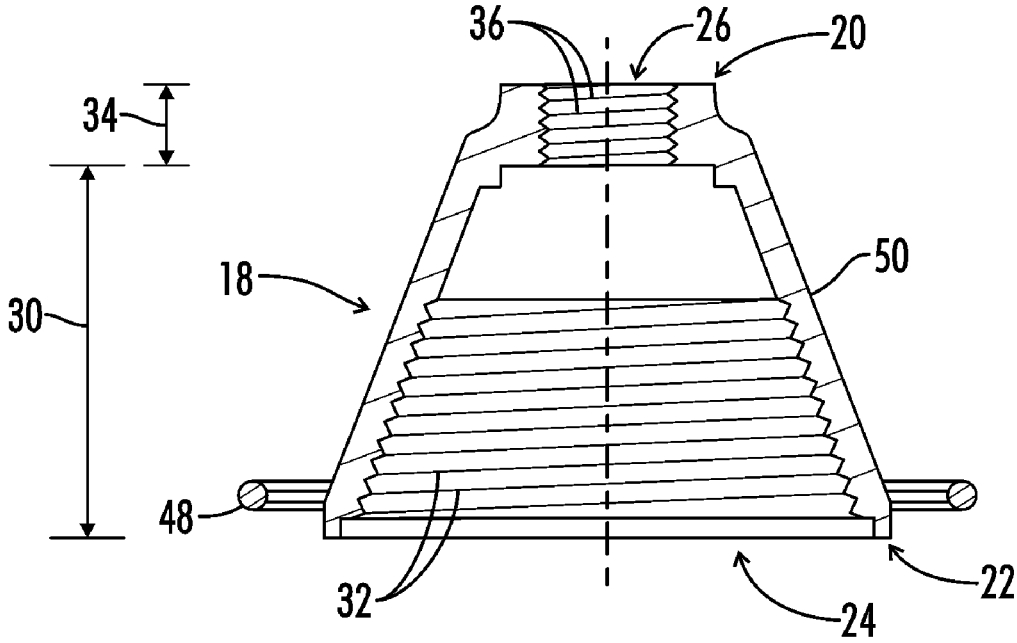
FIG. 5 is a cross-sectional view of a casing made in accordance with the current disclosure showing an example of internal threads within the casing.
Figure 6:
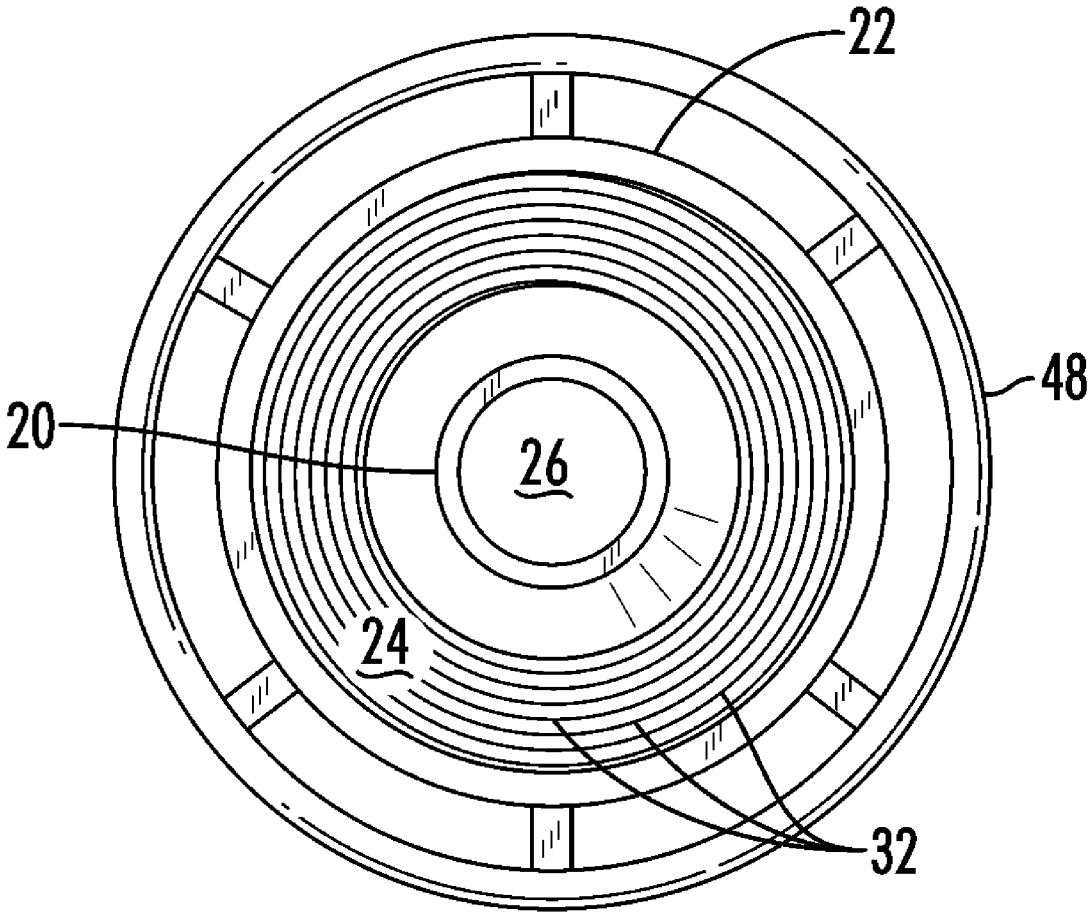
FIG. 6 is a bottom view of a lifting apparatus made in accordance with the current disclosure.

Referring generally now to FIGS. 1-6, a lifting apparatus is shown and generally designated by the numeral 10. The lifting apparatus 10 is for attaching to and transporting a carbon based electrode 12, which can also be a graphite electrode 12. The electrode 12 includes a threaded male end 14, which preferably includes at least one thread 16.

The lifting apparatus 10 preferably includes a casing 18 having a top end 20 and a bottom end 22. The casing 18 defines an electrode aperture 24, which can also be described as an electrode opening 24, positioned in the bottom end 22 wherein the electrode aperture 24 is shaped to accept the threaded male end 14 of the electrode 12. An attachment aperture 26 is positioned in the top end 20, which can also be described as a lifting end 20, and is shaped to accept an attachment element 28 positioned in the attachment aperture 26 wherein the attachment element 28 operatively engages the top end 20.

Preferably, the casing 18, which can also be described as a tapered boundary wall 18, is tapered from the bottom end 22 to the top end 20 such that the bottom end 22, which can also be described as an electrode end 22, has a larger diameter than the top end 20. This can alternately be described as the casing 18 being substantially bell shaped.

The casing 18 can further include a length 30 and a threaded internal surface 32 substantially spanning the length 30. The threaded internal surface 32 mates with the threaded male end 14 of the electrode 12 to secure the electrode 12 to the lifting apparatus 10. Additionally, the threaded internal surface 32 is substantially conical in shape and includes a substantially circular cross-sectional shape when this cross-sectional shape is taken perpendicular to the length 30.

The attachment aperture 26, which can also be described as a lifting opening 26, further includes an aperture length 34 and attachment threads 36 substantially spanning the aperture length 34. The attachment element 28, which can also be described as a lifting element 28, further includes a clipping element 38 and casing threads 40 extending from the clipping element 38. The casing threads 40, which can also be described as a threaded extension 40, mate with the attachment threads 36, which can also be described as lifting threads 36, of the attachment aperture 36 to engage the attachment element 28 to the attachment aperture 26.

In this embodiment, the casing threads 40 are external to the attachment element 28 while the attachment threads 36 are internal to the attachment aperture 26. Alternately, the attachment element 28 could engage the external surface 50 of the casing 18 such that the attachment threads 36 are positioned external to the casing 18 while the casing threads 40 of the attachment element 28 are positioned internal to the attachment element 28.

In a preferred embodiment an indexing element 42 is positioned within the casing 18 proximate to the top end 20. The indexing element 42 is positioned to regulate movement of the electrode 12 and the casing 18 with respect to the attachment element 28. This is best exampled by FIG. 3 wherein the indexing element 42 is part of the attachment element 28 and extends from the gripping element 38, which can also be described as a connection protrusion 38. The indexing element 42 can include a ring 44 that fits within a notch 46 internal to the casing 18. The indexing element 42 can be used to index the electrode 12 being held by the lifting apparatus 10 down as that electrode 12 is being added to a column of other electrodes. The electrode 12 to be added is spaced above the column, say for example approximately 2 inches. The electrode 12 is then rotated to engage that electrode 12 to the column for screwing the two together. As the electrode 12 is rotated, the indexing element 42 allows movement of the electrode 12 and the casing 18 with respect to the attachment element 28 to limit the application of undue force on the electrode 12. Additionally, the indexing element 42 facilitates a downward travel speed that is substantially consistent with the travel speed of the electrode 12 so that as the load is substantially supported.

The casing 18 could further include a handle 48 attached to the external surface 50 of the casing 18. Preferably the handle 48 is positioned proximate to the bottom end 22 of the casing 18 and is spaced from the internal surface 50. The handle 48 can be a handle known in the art to allow proper manual gripping and manipulation of items corresponding to the lifting apparatus 10.

Also included is a lifting apparatus 10 for transporting a graphite electrode 12 having a threaded male end 14. The apparatus 10 comprises a tapered boundary wall 18 including a lifting end 20 and an electrode end 22. The tapered boundary wall 18 defines an electrode opening 24 in the electrode end 22 and a lifting opening 26 in the lifting end 20. The electrode opening 24 includes at least one electrode thread 32 shaped to securely engage the threaded male end 14 of the electrode 12 in the electrode opening 24. The lifting opening 26 includes at least one lifting thread 36. A lifting element 28 is positioned in the lifting opening 26 and includes a threaded extension 40 operatively engaging the lifting threads 36 to securely engage the lifting element 28 in the lifting opening 26.

Preferably the threaded extension 40 extends within the tapered boundary wall 18 from the lifting end 20 towards the electrode end 22. Preferably the threaded extension 40 regulates movement of the electrode 12 and the tapered boundary wall 18 with respect to the lifting element 28. A connection protrusion 38 extends from the threaded extension 40 outwardly from the tapered boundary wall 18.

The lifting opening 26 further includes an opening length 34 wherein the lifting threads 36 substantially spans the opening length 34. Additionally, the tapered boundary wall 18 further includes a length 30 wherein the electrode threads 32 substantially span the length 30.

The lifting apparatus 10 is such that a user of the lifting apparatus 10 can position the lifting apparatus 10 on an electrode 12 without the use of additional tools or equipment. The user can slide the threaded male end 14 of the electrode 12 into the electrode opening 24 and rotate the lifting apparatus 10 to engage the electrode threads 32 of the lifting apparatus 10 to the threaded male end 14 of the electrode 12. This can be accomplished without the use of a crane or other equipment in order to maximize the use of the facilities and/or of equipment in the electric arc furnace industry.

The depth of entry of the threaded male end 14 of the electrode 12 into the lifting apparatus 10 can be controlled. For example, the threaded internal surface 32 can stop at a predetermined distance of the length 30 of the casing 18 such that the threaded male end 13 of the electrode 12 no longer has electrode threads 32 to engage.

Also included is a method of lifting a carbon based electrode having a threaded male end. The method comprises providing a lifting apparatus having internal threads and attaching the internal threads of the lifting device to the threads of the threaded male end of the electrode. The method further includes indexing the carbon based electrode a secure distance within the lifting apparatus and lifting the carbon based electrode by the lifting apparatus. Preferably the method includes allowing substantially unobstructed access to the carbon based electrode below the threaded male end. Additionally the method preferably includes manually attaching the lifting apparatus to the electrode and manually indexing the carbon based electrode within the lifting apparatus.

Thus, although there have been described particular embodiments of the present invention of a new and useful Lifting Apparatus and Method of Lifting Carbon Based Electrodes, it is not intended that such references be construed as limitations upon the scope of this invention except as set forth in the following claims.

What is claimed is:

1. A lifting apparatus for transporting a carbon based electrode having a threaded male end, the apparatus comprising:

a casing including a top end and a bottom end, the casing defining an electrode aperture in the bottom end shaped to accept the threaded male end of the carbon based electrode and an attachment aperture in the top end;

an attachment element positioned in the attachment aperture and operatively engaging the top end to permit transfer and positioning of a carbon based electrode, the attachment element including an indexing element position within the casing proximate to the top end, the index element shaped and positioned to regulate the vertical movement of the carbon based electrode and the casing with respect to the attachment element and to stop downward movement of the casing with respect to the attachment element.

2. The lifting apparatus of claim 1, wherein the casing is tapered from the bottom end to the top end and includes a substantial conical.

3. The lifting apparatus of claim 1, the casing further including a length and a threaded internal surface substantially spanning the length.

4. The lifting apparatus of claim 3, wherein the threaded internal surface mates with the threaded male end of the electrode.

5. The lifting apparatus of claim 1, the casing further including an external surface and a handle attached to the external surface and positioned proximate the bottom end.

6. The lifting apparatus of claim 5, wherein the handle is spaced from the external surface.

7. The lifting apparatus of claim 1, the casing further including a length wherein the cross-sectional shape of the casing perpendicular to the length is substantially circular.

8. The lifting apparatus of claim 1, the attachment aperture further including and aperture length and attachment threads substantially spanning the aperture length.

9. The lifting apparatus of claim 8, the attachment element further including a gripping element and casing threads extend from the gripping element wherein the attachment threads mate with the casing threads.

10. The lifting apparatus of claim 1, wherein the indexing element extends from the attachment element.

11. The lifting apparatus of claim 1, further including a fastener removably attaching the attachment element to the top end.

12. The lifting apparatus of claim 1, wherein the casing is substantially bell shaped externally and substantially conically shaped internally.

13. A lifting apparatus for transporting a graphite electrode having a threaded male end, the apparatus comprising:

a tapered boundary wall including an lifting end and an electrode end, the tapered boundary wall defining an electrode opening in the electrode end and a lift opening in the lifting end, wherein:

the electrode opening includes at least one electrode thread shaped to securely engage the threaded male end of the graphite electrode in the electrode opening; and the lifting opening including at least one lifting thread; and a lifting element positioned in the lifting opening and including a threaded extension operatively engaging the lifting thread to securely engage the lifting element in the lifting opening to permit transfer and positioning of a carbon based electrode, the threaded extension extending within the tapered boundary wall from the lifting end toward the electrode end and shaved and positioned to regulate movement of the graphite electrode and the tapered boundary wall with respect to the lifting element and to stop downward movement of the tapered boundary wall with respect to the lifting element.

14. The lifting apparatus of claim 13, wherein the tapered boundary wall is substantially bell shaped.

15. The lifting apparatus of claim 13, the lifting element further including a connection protrusion extending from the threaded extension.

16. The lifting apparatus of claim 13, the lifting opening further including an opening length and the at least one lifting thread substantially spans the opening length.

17. The lifting apparatus of claim 16, the tapered boundary wall further including a length and at least one electrode thread substantially spans the length.

* * * * *